US005632569A

United States Patent [19]

Szmansky

[11] Patent Number: 5,632,569

[45] Date of Patent: May 27, 1997

[54] CEMENT FINISHING HAND TOOL

[76] Inventor: Les Szmansky, P.O. Box 420529, Summerland Key, Fla. 33042

[21] Appl. No.: 492,377

[22] Filed: Jun. 19, 1995

[51] Int. Cl.[6] ..... E01C 19/22; E01C 19/38

[52] U.S. Cl. ..... 404/97; 404/114; 15/235.4

[58] Field of Search ..... 404/96, 97, 101, 404/102, 114, 118, 113, 115, 133.1; 15/235.4, 235.5, 235.8, 245; 366/128

[56] References Cited

U.S. PATENT DOCUMENTS

| | | | |
|---|---|---|---|
| 2,289,248 | 7/1942 | Davis | 94/24 |
| 2,952,028 | 9/1960 | Robbins | 15/235.4 |
| 3,376,798 | 4/1968 | Bodine | 94/48 |
| 4,073,593 | 2/1978 | Storm | 404/114 |
| 4,359,296 | 11/1982 | Cronkhite | 404/114 |
| 4,641,995 | 2/1987 | Owens | 404/118 |
| 4,653,957 | 3/1987 | Smith et al. | 404/114 |
| 5,234,283 | 8/1993 | Adkins | 404/97 |
| 5,467,496 | 11/1995 | Jarvis | 15/235.8 |

*Primary Examiner*—James Lisehora
*Attorney, Agent, or Firm*—Malloy & Malloy, P.A.

[57] ABSTRACT

An improved cement finishing hand tool having a handle member with a gripper shaft, a proximal end and a distal end, the distal end being substantially downwardly angled so as to be removably engaged with an upper surface of a removable blade member. The removable blade member is interchangeably secured to the handle member which is structured to independently vibrate resulting in the translation of the vibration from the handle member through the blade member. This vibration facilitates the production of a corresponding desired finish as the lower surface of the blade member is passed over wet cement during the initial and final stage finishing procedures.

4 Claims, 1 Drawing Sheet

CEMENT FINISHING HAND TOOL

BACKGROUND OF THE INVENTION

1. Field of the Invention

The present invention relates to an improved cement finishing hand tool, structured to be conveniently and easily useable, independent from any external connections, and to facilitate rapid and convenient use to provide a number of different required finishes.

2. Description of the Related Art

When cement is poured so as to form sidewalks, foundations, etc., it is generally desirous to provide a smooth, flat exterior surface prior to drying. In particular, stones and other particles can often remain on top the cement surface, which can provide an uneven finish or can provide irregular areas within the cement that result in uneven hardening as the cement settles down during drying.

Accordingly, others in the art have turned to vibrating equipment to help remove some of the imperfections after the cement has been poured. Generally, these types of tools, such as in the patent to Adkins (U.S. Pat. No. 5,234,283) are large specialized skimmers disposed on elongated poles to provide the preliminary surfacing of the poured cement. As such, finishing of the cement is still required, utilizing a variety of different hand tools, each having its own specialized purpose.

Additionally in the art, basic skimmer/trowel hand tools, such as those cited in the patents to Smith et al. (U.S. Pat. No. 4,653,957), Bodine (U.S. Pat. No. 3,376,798) and W. P. Day et al. (U.S. Pat. No. 2,400,341) have been developed. These tools, however, while providing some vibration for finishing purposes will generally require an elongated cord or air hose to enable them to function. Accordingly, the tools can be very difficult and cumbersome to use, and a user must go to great lengths to ensure that the hose or cord remains out of the still wet, finished cement. Additionally, when a worker is in a small confined area, or is kneeling down to finish the surface, a variety of different tools, such as a float, a jointer, an edger, etc., must be utilized. Generally, it is quite inconvenient and cumbersome to have all of these individual tools handy, an inconvenience that is further heightened if the tools are heavy and/or are connected to an elongate air or power hose. As such, there is still a substantial need in the art for a safe and effective method of providing for multiple and varying surfacing of the wet cement in a convenient manner that does not require a variety of different hand tools to be carried by a user and increases the workers ability to provide a smooth finish.

The device of the present invention is designed precisely to overcome many of the problems remaining with prior art devices by providing an apparatus which is specifically adapted to be hand-held, non-cumbersome and easily useable and maneuverable, while being conveniently and quickly adaptable for use in a variety of finishing circumstances. Further, the device of the present invention enables a worker to conveniently have a variety of effective tools at his/her disposal during all finishing stages and recognizes the yet unidentified benefits of vibration at the finishing stages and with many different tools.

SUMMARY OF THE INVENTION

The present invention is directed to an improved cement finishing hand tool, to be used in the initial and final finishing stages of setting wet cement for hardening. The hand tool includes a handle member which has a gripper shaft, a proximal end and a distal end. The gripper shaft is specifically structured and disposed to be grasped by one hand of a user for convenient holding and manipulation. Further, the distal end of the handle member is downwardly angled relative to the gripper shaft.

The finishing hand tool of the present invention also includes at least one removable blade member structured and disposed for passage over a quantity of wet cement. This blade member, which has an upper surface and lower surface, has its lower surface specifically structured and configured such that it will provide a select finish to the wet cement over which it passes.

So as to removably secure the distal end of the handle member with the upper surface of the removable blade member, the hand tool includes engagement means. The engagement means are structured to secure the handle member and blade member to one another such that the blade member can be effectively manipulated by the handle member during use when the lower surface of the blade member is passed over the wet cement. Further, the engagement means are structured to permit the blade member to be effectively removed from the handle member, thereby facilitating cleaning and storage of the blade member independent from the handle member and allowing for replacement of an alternative blade member when necessary.

Finally, the finishing hand tool of the present invention includes vibration means disposed in the handle member and structured to vibrate the handle member during use. By vibrating the handle member the vibration is transferred into the attached blade member, such that the blade member will vibrate as it is passed over the wet cement to provide a smoother and better finish to the wet cement. The vibration means are powered by independent power means which are preferably disposed within the handle member. Further, switching means are positioned on the handle member so as to enable the user to turn on the vibration means during use.

It is an object of the present invention to provide an improved cement finishing hand tool which is structured to enable a user to provide a variety of different finishes, quickly and conveniently utilizing the same tool.

Still another object of the present invention is to provide an improved cement finishing hand tool which does not include any cords or wires extending therefrom, yet which is structured to vibrate so as to improve a finish provided by the hand tool.

Yet another object of the present invention is to provide an improved cement finishing hand tool which is structured to vibrate so as to improve the finish on a variety of different finishing stages, all capable of being performed utilizing the same tool.

Another object of the present invention is to provide an improved cement finishing hand tool which will provide an improved finish to wet cement and which will enable a user to provide a variety of different finishes in a small confined location without having to carry a number of tools or without having to obtain a number of different tools for use at a particular time.

Also an object of the present invention is to provide an improved cement finishing hand tool wherein the blade portion, which actually contacts the wet cement, can be quickly and conveniently be cleaned without risking damage to a remainder of the hand tool.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
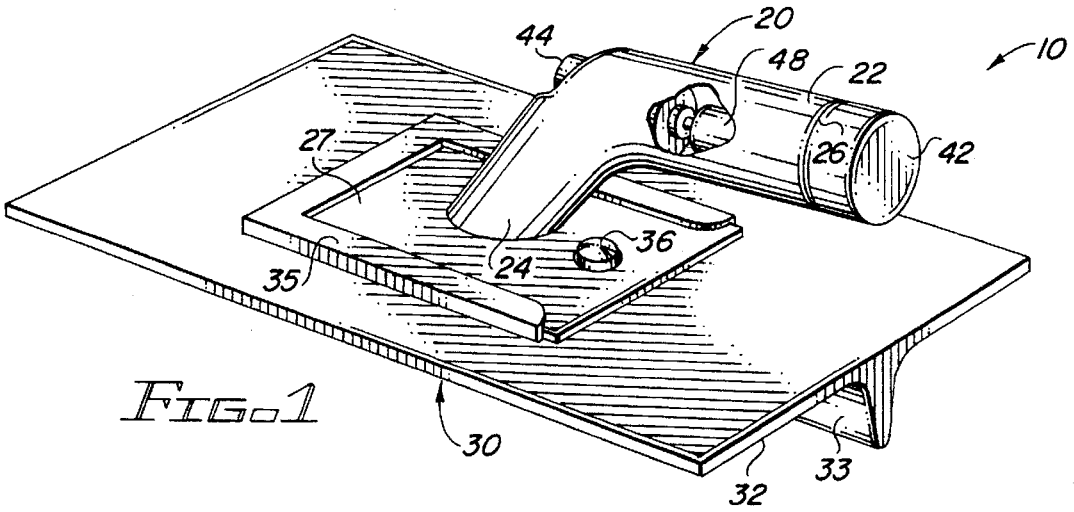
FIG. 1 is a perspective view of the cement finishing hand tool of the present invention.
Figure 2:
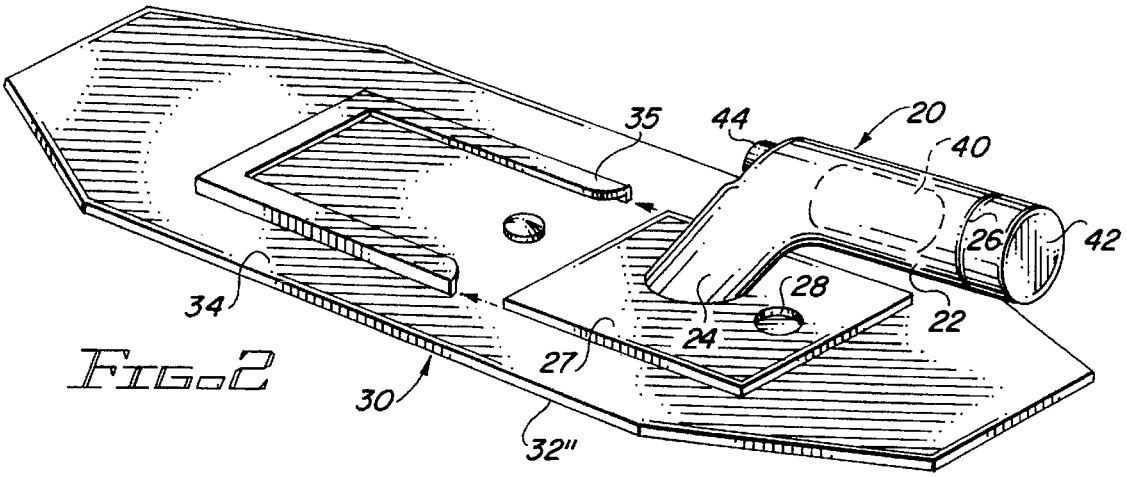
FIG. 2 is an exploded view of the cement finishing hand tool of the present invention including an additional embodiment of the blade member.

Shown throughout the drawings, the present invention is directed towards an improved cement finishing hand tool, generally indicated as 10. The hand tool 10 of the present invention is designed specifically for use in a initial and final, cement finishing stage of laying a cement slab, where a hand tool is necessary for a variety of finishing procedures such as edging, spacing and smoothing. As such, the hand tool 10 of the present invention is substantially light weight and convenient to manipulate and use.

The cement finishing hand tool 10 of the present invention includes a handle member 20 having a gripper shaft 22, a proximal end 26 and a distal end 24. The gripper shaft is specifically structured to be grasped comfortably and conveniently by one hand of a user to facilitate manipulation thereof. The distal end 24 of the handle member 20 preferably disposed at a downward angle relative to the gripper shaft 22, and in many cases may be offset almost 90 degrees from the gripper shaft 22. Further, the distal end 24 is structured to be removably secured with one of preferably a plurality of blade members 30. In particular, the downward angle is provided between the distal end 24 and the gripper shaft 22, such that the gripper shaft 22 will be somewhat parallel to the blade members 30 during use, thereby facilitating easy and convenient manipulation over the wet cement by a user.

Turning to the blade members 30, the cement finishing hand tool 10 of the present invention will include at least one, but preferably a plurality of removable blade members 30. Each of the blade members 30 includes a bottom surface 32 and a top surface 34. The bottom surface 32 is the portion of the blade member 30 that is structured to pass over and engage the wet cement in order to provide the appropriate finishing thereto. As such, a first embodiment of the blade members 30 incorporates a spacer bottom surface 32 having an elongate, substantially centrally disposed ridge 33 extending along a length thereof. This particular blade member 30 is structured to form a spacer groove to define adjacent segments of concrete and provide room for the expansion of the individual segments during drying, without cracking. In another alternative embodiment, the blade member 30 can include an edger bottom surface 32'. This edger bottom surface 32' includes a single ridge 33' along one end thereof, and is structured to facilitate the formation of the perimeter edges of a concrete slab or segment. Finally, yet another embodiment of the blade member 30 includes a smooth bottom surface 32', which is smooth so as to function as a float to be used for final touch-up smoothing of the wet cement.

The handle member 20 and blade member 30 are structured to be removable secured with one anther, and as such engagement means are included. Although a variety of engagement means can be incorporated, in the preferred embodiment the engagement means will include a guide panel 27 disposed at the distal end 24 of the handle member 20. The guide panel 27 is structured and disposed for slided engagement within a guide track 36 correspondingly disposed on the upper surface 34 of the blade member 30. Accordingly, during use the guide panel 27 slides into the guide track 35 and provides a secure engagement between the handle member 20 and a select blade member 30. Further, in the preferred embodiment, the guide track 35 will include a flanged lip under which the guide panel 27 is retained. This lip on the guide track 35 allows facilitated interconnected manipulation of the blade members 30 by moving the handle member 20, while still allowing for removability of the handle member 20 from the blade members 30. It is of particular benefit for the blade members 30 to be easily and conveniently removable so as to facilitate rapid interchanging between the variety of different blade members 30 incorporated as part of the present invention. As such, a worker that is working in a specific area, and is often crouching or kneeling can maintain a plurality of the different blade members 30, conveniently disposed in a pouch or tool belt. When a different surface finish is required in the immediate work area, the user must merely slide the handle member 20 out from the blade member 30, and replace a new blade member 30 having a select bottom surface to meet the appropriate finishing needs.

Additionally, and in order to facilitate a more stable interconnection between the handle member 20 and the select blade member 30, lock means are preferably included. In the preferred embodiment, the lock means will include a biased protruding nub 36. The nub 36 is disposed to extend upwardly from the upper surface 34 of the blade member 30, within the perimeter lip of the guide track 35. This biased, protruding nub 36 is structured and disposed for secure fitting engagement within a corresponding recess 28 disposed in the guide panel 27. Specifically, when the guide panel 27 slides into the guide track 35 for appropriate engagement between the handle member 20 and blade member 30, the nub 36 is compressed downwardly under the guide panel 27. When, however, the guide panel 27 has moved sufficiently into the guide track 35 such that the corresponding recess 28 in the guide panel 27 is centered over the nub 36, the biased nature of the nub 36 will force it into the corresponding recess 28 so that the nub 36 protrudes therethrough to secure the handle member 20 into locking engagement with the blade member 30. Similarly, when the user wishes to remove the blade member 30 from the handle member 20 for appropriate cleaning or interchanging of the blade member 30, the nub must merely be pushed down until the guide panel 27 is able to be pulled such that the nub is no longer centered at the corresponding recess 28. At that point the blade member 30 can merely be pulled from the handle member 20.

Figure 3:
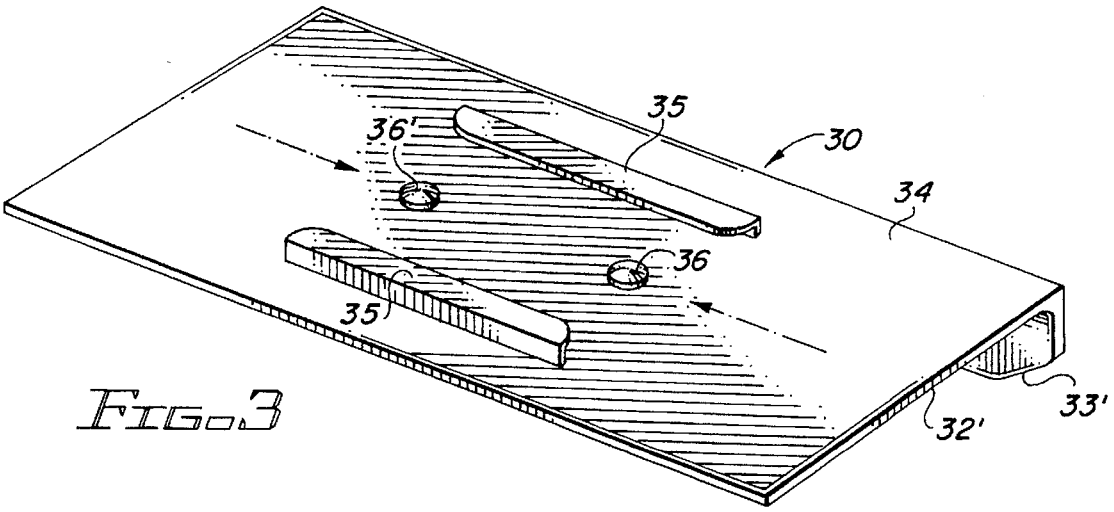
FIG. 3 is another embodiment of the blade member of the hand tool of the present invention.

Also, as illustrated in the alternative embodiment of FIG. 3 relating to the edging member, because a user must often do opposing edges within a specific area, and it may be difficult for that user to twist their hand or grip the improved finishing cement hand tool 10 in a backward manner or with an opposite hand, this alternative embodiment includes means to facilitate opposing positioning of the handle member 20 with relation to the blade member 30. In particular, in this embodiment the guide track 35 is structured such that the guide panel 27 may slide into it from either side. Additionally, a second protruding nub 36' is disposed within the confines of the guide track 35 on the upper surface of the blade member 30 in a spaced position opposite the first protruding nub 36. As such, a user may insert the handle member 20 in an appropriate left-handed or right-handed orientation, depending on the specific needs of the user at that particular time or depending on whether or not the user is left-handed or right-handed.

Included within the gripper shaft 22 of the handle member are vibration means 40. The vibration means 40 are specifically structured so as to cause the handle member 20 to vibrate in such a manner that the vibration of the handle member 20 is translated through the distal end 24 of the handle member 20 and to the blade member 30 resulting in corresponding vibration thereof as it passes over the wet cement. The vibration caused by the vibration means 40 should not be substantially severe, but should be merely sufficient so as to facilitate the smoothing of the wet cement during all of the finishing procedures. Although a variety of vibrating means may be incorporated, in the preferred embodiment, so as to facilitate the complete containment of the vibrating means 40 within the handle member 20, the vibrating means 40 include an unbalanced rotating motor contained within the gripper shaft 22. Accordingly, upon rotation of the various components of the unbalanced rotating motor within the gripper shaft 22, the entire handle member 20 will begin to vibrate for translation to the blade member 30. In order to initiate and maintain rotation of the motor, and accordingly the production of the necessary vibration, powering means are included. These powering means are structured to be substantially contained as part of the handle member 20 so as to eliminate the need for unnecessary protrusions or chords. In the preferred embodiment the powering means include a rechargeable battery 42 which connects at the proximal end 26 of the handle member 20. Although disposable batteries may be utilized, it is preferred that a rechargeable, completely removable battery pack 42 be utilized, the battery pack 42 being independently re-chargeable and connected with the handle member 20 for use.

Finally, disposed conveniently in a thumb actuatable orientation are switching means 44. In the preferred embodiment, the switching means 44 will be a push button type switch, and can either be a momentary switch that must remain pushed in order to result in the vibration, or can merely be an on/off switch that can be switched to an "on" position and later on be pushed again to switch off the vibration means 40.

While this invention has been shown and described in what is considered to be a practical and preferred embodiment, it is recognized that departures may be made within the spirit and scope of this invention which should, therefore, not be limited except as set forth in the claims which follow and within the doctrine of equivalents.

Now that the invention has been described,

What is claimed is:

1. An improved cement finishing hand tool comprising:

a handle member, said handle member including a gripper shaft, a proximal end, and a distal end, said gripper shaft being structured and disposed to be grasped by one hand of a user, said distal end being downwardly angled relative to said gripper shaft, a plurality of interchangeable, removable blade members structured and disposed for passage over a quantity of wet cement, each of said blade member including an upper surface and a lower surface, said lower surface of each of said blade members being structured to provide a select finish to the wet cement over which it is passed, engagement means structured and disposed to securely, yet removably secure said distal end of said handle member with said upper surface of said removable blade member, such that said blade member can be effectively manipulated by said handle member during use and said blade member can be effectively removed from said handle member to facilitate cleaning and storage of said blade member independent of said handle member, vibration means disposed in said handle member and structured to vibrate said handle member and accordingly said blade member which is secured thereto by said engagement means, power means structured and disposed to provide power to said vibration means, switching means structured and disposed to enable the user to turn on said vibration means during use, and said engagement means comprising:

a guide track disposed on said upper surface of each of said plurality of blade members, said guide track being structured to receive said distal end of said handle member for engagement therein, a guide panel disposed on said distal end of said handle member and structured for secure, slided engagement into said guide track on said upper surface of each of said blade members, and lock means structured and disposed to removably secure said guide panel in said guide track, said lock means including a biased, protruding nub structured for securing engagement within a corresponding recess so as to achieve effective interconnection of said guide panel within said guide track.

2. An improved cement finishing hand tool as recited in claim 1 wherein said vibration means includes an unbalanced rotating motor structured to vibrate within said gripper shaft and accordingly vibrate said gripper shaft and said blade member secured thereto.

3. An improved cement finishing hand tool as recited in claim 2 wherein said switching means includes an on/off switch disposed in said gripper shaft so as to facilitate actuation by the hand of the user grasping said gripper shaft.

4. An improved cement finishing hand tool as recited in claim 3 wherein said power means includes at least one battery disposed in said gripper shaft of said handle member.

* * * * *